US009446885B2

(12) United States Patent
Doubles et al.

(10) Patent No.: US 9,446,885 B2
(45) Date of Patent: Sep. 20, 2016

(54) CONTAINER WITH A REMOVABLE MEASURING CAP

(71) Applicant: Kraft Foods Group Brands LLC, Northfield, IL (US)

(72) Inventors: Allison Doubles, Westport, CT (US); Shelley Markoulis, Wyckoff, NJ (US); Jason Braun, Lake Hiawatha, NJ (US); Stuart M. Leslie, Larchmont, NY (US); Roland Zeder, New York, NY (US)

(73) Assignee: Kraft Foods Group Brands LLC, Chicago, IL (US)

( * ) Notice: Subject to any disclaimer, the term of this patent is extended or adjusted under 35 U.S.C. 154(b) by 0 days.

(21) Appl. No.: 14/441,819

(22) PCT Filed: Nov. 5, 2013

(86) PCT No.: PCT/US2013/068432

§ 371 (c)(1),
(2) Date: May 8, 2015

(87) PCT Pub. No.: WO2014/074488

PCT Pub. Date: May 15, 2014

(65) Prior Publication Data

US 2015/0284150 A1 Oct. 8, 2015

Related U.S. Application Data

(60) Provisional application No. 61/724,907, filed on Nov. 10, 2012.

(51) Int. Cl.
*B67D 1/16* (2006.01)
*B65D 41/56* (2006.01)

(Continued)

(52) U.S. Cl.
CPC ..... *B65D 41/56* (2013.01); *B65D 41/26* (2013.01); *B65D 47/06* (2013.01); *B65D 47/122* (2013.01);

(Continued)

(58) Field of Classification Search
CPC .... B65D 41/56; B65D 41/565; B65D 41/26; B65D 41/265; B65D 47/06; B65D 47/0804; B65D 47/122; B65D 47/40; B65D 75/002; B65D 51/18
USPC ..... 222/1, 109, 111, 562, 566–570; 215/228, 566–570
See application file for complete search history.

(56) References Cited

U.S. PATENT DOCUMENTS 1,780,875 A 11/1930 Gordon
2,061,685 A 11/1936 Wheaton (Continued)

FOREIGN PATENT DOCUMENTS

CN 101472806 A 7/2009
CN 202080532 U 12/2011

(Continued)

OTHER PUBLICATIONS

International Preliminary Report on Patentability for International Application No. PCT/US2013/068432, dated May 12, 2015 (6 pgs.).

(Continued)

*Primary Examiner* — Lien Ngo
(74) *Attorney, Agent, or Firm* — Fitch, Even, Tabin & Flannery LLP

(57) ABSTRACT

A container for dispensing a liquid concentrate comprises a container body with top edge and a cap base sealed relative to the top edge. The cap base includes a wall having an inner thread, a funnel surrounding an opening, and a spout. The container includes a cap top with a shoulder including a flange having an outer thread and depending downwardly from the shoulder to define a channel being open toward a bottom edge of the cap top and located between an interior of the flange and the sidewall of the cap top. The cap top can be threadingly engaged to the cap base to form an outer seal between at least one of the shoulder and the flange of the cap top and the wall of the cap base and form an inner seal between the bottom edge of the sidewall of the cap top and the funnel of the cap base.

22 Claims, 9 Drawing Sheets

(51) Int. Cl.

| | |
|---|---|
| ***B65D 41/26*** | (2006.01) |
| ***B65D 47/06*** | (2006.01) |
| ***B65D 47/40*** | (2006.01) |
| ***B65D 47/12*** | (2006.01) |
| ***B65D 51/18*** | (2006.01) |
| ***B65D 75/00*** | (2006.01) |
| ***B65D 75/58*** | (2006.01) |
| ***B65D 85/72*** | (2006.01) |

(52) U.S. Cl.

CPC ..... *B65D 47/40* (2013.01); *B65D 51/18* (2013.01); *B65D 75/002* (2013.01); *B65D 75/5844* (2013.01); *B65D 85/72* (2013.01); *B65D 2251/0015* (2013.01); *B65D 2251/0028* (2013.01); *B65D 2251/0087* (2013.01)

(56) References Cited

U.S. PATENT DOCUMENTS

| | | | | |
|---|---|---|---|---|
| 2,185,699 | A | 1/1940 | Zeugner | |
| 2,219,146 | A | 10/1940 | Zeugner | |
| 2,226,340 | A | 12/1940 | Flood | |
| 2,804,103 | A | 8/1957 | Hall | |
| 4,269,319 | A | 5/1981 | Rubens | |
| 4,550,862 | A | 11/1985 | Barker | |
| 4,566,508 | A | 1/1986 | Bowyer | |
| 4,671,421 | A | 6/1987 | Reiber | |
| 4,696,416 | A | 9/1987 | Muckenfuhs | |
| 4,706,829 | A | 11/1987 | Li | |
| 4,773,560 | A | 9/1988 | Kittscher | |
| 4,792,664 | A | 12/1988 | Schwab | |
| 4,844,302 | A | 7/1989 | Lay | |
| 4,890,770 | A | 1/1990 | Haga | |
| 4,917,268 | A | 4/1990 | Campbell | |
| 4,917,270 | A | 4/1990 | Simon | |
| 4,928,514 | A | 5/1990 | Beaston | |
| 4,974,749 | A | 12/1990 | Mon | |
| 4,989,757 | A | 2/1991 | Krall | |
| 5,020,699 | A | 6/1991 | Sams | |
| 5,078,289 | A | 1/1992 | Bolton | |
| 5,108,009 | A | 4/1992 | Davidson | |
| D336,614 | S | 6/1993 | Crawford | |
| D345,114 | S | 3/1994 | Puls | |
| 5,431,306 | A | 7/1995 | Reid | |
| 5,566,862 | A | 10/1996 | Haffner | |
| 5,603,787 | A | 2/1997 | Reid | |
| 5,865,331 | A | 2/1999 | Jacobs | |
| 5,881,894 | A | 3/1999 | Gargano | |
| 5,941,422 | A * | 8/1999 | Struble | B29C 65/0672 222/109 |
| 6,032,829 | A | 3/2000 | Geisinger | |
| 6,123,231 | A | 9/2000 | Geisinger | |
| 6,223,945 | B1 | 5/2001 | Giblin | |
| 6,223,946 | B1 | 5/2001 | Geisinger | |
| 6,279,789 | B1 | 8/2001 | Krall | |
| 6,375,041 | B1 | 4/2002 | Klima | |
| 6,431,401 | B1 | 8/2002 | Giblin | |
| 6,464,106 | B1 * | 10/2002 | Giblin | B65D 1/0207 215/12.1 |
| 6,500,380 | B1 | 12/2002 | Geisinger | |
| 6,508,375 | B1 | 1/2003 | Krall | |
| 6,637,176 | B1 | 10/2003 | Krall | |
| 6,648,188 | B2 | 11/2003 | Brecheisen | |
| 6,705,495 | B2 | 3/2004 | Brecheisen | |
| 7,032,632 | B2 | 4/2006 | Shingle | |
| 7,097,076 | B1 | 8/2006 | Giblin | |
| 7,147,020 | B2 | 12/2006 | Bronner | |
| D538,668 | S | 3/2007 | Campbell | |
| 7,390,453 | B2 | 6/2008 | Brecheisen | |
| 7,407,067 | B2 | 8/2008 | Kerkhof | |
| 7,721,916 | B2 | 5/2010 | Szekely | |
| D624,426 | S | 9/2010 | Currington | |
| 7,959,034 | B2 | 6/2011 | Faaborg | |
| D644,531 | S | 9/2011 | Padain | |
| 8,011,535 | B2 | 9/2011 | Tauber | |
| 8,025,183 | B2 | 9/2011 | Szekely | |
| 8,651,304 | B2 * | 2/2014 | Skillin | B65D 41/26 141/381 |
| 2002/0153388 | A1 | 10/2002 | Klima | |
| 2004/0118881 | A1 | 6/2004 | Brecheisen | |
| 2004/0173634 | A1 | 9/2004 | Pagovich | |
| 2006/0175349 | A1 | 8/2006 | Drosos | |
| 2007/0113920 | A1 | 5/2007 | Bronner | |
| 2007/0194047 | A1 | 8/2007 | Tauber | |
| 2008/0011710 | A1 | 1/2008 | Cohn | |
| 2008/0017665 | A1 | 1/2008 | Brecheisen | |
| 2008/0116164 | A1 | 5/2008 | Dellinger | |
| 2008/0164282 | A1 * | 7/2008 | Szekely | B65D 47/123 222/111 |
| 2009/0045224 | A1 * | 2/2009 | Faaborg | B65D 41/0471 222/111 |
| 2010/0043910 | A1 | 2/2010 | Szekely | |
| 2011/0226721 | A1 | 9/2011 | Horstman | |
| 2011/0290756 | A1 | 12/2011 | Horstman | |
| 2011/0302888 | A1 | 12/2011 | Szekely | |
| 2011/0303698 | A1 | 12/2011 | Tauber | |
| 2011/0309104 | A1 | 12/2011 | Tauber | |
| 2011/0309105 | A1 | 12/2011 | Tauber | |
| 2012/0012613 | A1 | 1/2012 | Tauber | |

FOREIGN PATENT DOCUMENTS

| | | | |
|---|---|---|---|
| GB | 2150102 | A | 6/1985 |
| JP | 2007276810 | A | 10/2007 |
| JP | 2010126232 | A | 6/2010 |
| WO | 2009025717 | A1 | 2/2009 |

OTHER PUBLICATIONS

International Search Report for International Application No. PCT/US2013/068432, dated Mar. 13, 2014 (4 pgs.).

English translation of Notice on the First Office Action dated Mar. 21, 2016 for Chinese Application No. 201380057449.5 (10 pgs.).

* cited by examiner

CONTAINER WITH A REMOVABLE MEASURING CAP

CROSS-REFERENCE TO RELATED APPLICATIONS

This application is a U.S. National Phase application filed under 35 U.S.C. §371 of International Application PCT/US2013/68432, filed Nov. 5, 2013, designating the United States, which claims the benefit of U.S. Provisional Patent Application No. 61/724,907, filed Nov. 10, 2012, both of which are incorporated by reference herein in their entirety.

FIELD

Containers with removable measuring caps are described herein and, in particular, containers including removable measuring caps that can be sealingly attached to the containers.

BACKGROUND

Plastic containers are used to store powders and liquid concentrates combinable with liquids such as water, soda, or the like to form ready to drink beverages. It can be desirable for such containers to include a removable cap that can be used to both cover the container opening and as a measuring cup for dispensing the beverages from the container. Such caps are commonly used with containers storing liquid detergents. To dispense the liquid material from such detergent containers, the consumer may remove the cap and pour a suitable amount of the liquid material into the cap, for example, to a preset measuring line.

One disadvantage of such caps is that if the liquid material inadvertently drips onto an exterior of the sidewall of the cap, the liquid material could drip along the sidewall and soil a sidewall of the container, or an underlying surface such as a table, or a consumer's clothing. Another disadvantage of such caps is that if the liquid material drips or is spilled onto the interior of the sidewall of the cap, the liquid material may drip onto threads connecting the cap to the container, the threads can become soiled and transfer the liquid material onto the threads on the neck of the container. This may undesirably cause the threads of the cap and the container neck to stick to each other. Yet another disadvantage of such caps is that the threaded connection between the cap and the container neck may provide the only seal for the container and when the container is inadvertently inverted, the liquid material may leak out of the container or may flow into the interface between the threads of the cap and the container and soil the interface.

Some detergent caps include a sidewall that includes a fluid collection channel. Such channels may restrict and/or prevent the liquid material from dripping all the way down the sidewall of the cap. However, threads located in the channel can be exposed to the liquid material collected in the channel. As such, the threads of such channels can become soiled and undesirably transfer the liquid material to the threads of the container neck.

SUMMARY

A container for dispensing a liquid concentrate includes a container body with a top edge surrounding a container opening, a cap base sealed relative to the top edge of the container body, and a cap top configured to be removably attached to the cap base. The cap base includes a pour spout and a funnel surrounding a pour opening. In the event that a consumer inadvertently spills the liquid concentrate onto the cap base when pouring the liquid concentrate from the container body into the cap top, the cap base includes a funnel surrounding the pour opening for directing the liquid concentrate back into the interior of the body. In addition, to restrict any spilled liquid concentrate from dripping along a sidewall of the cap base, the cap base further includes a channel for collecting the dripping liquid concentrate. The cap base includes a shoulder with flange having an outer thread located outside of the channel and restricted from coming into contact with the liquid concentrate being collected into the channel. The cap top forms multiple seals with the cap base with an outer seal formed between at least one of the shoulder and the flange of the cap top and the wall of the cap base; and an inner seal formed between the bottom edge of the sidewall of the cap top and the funnel of the cap base.

In one form, the container includes gripping means for dispensing the liquid concentrate in a preferred orientation of the spout. The container may include a shrink wrap sleeve covering at least a portion of each of the cap top, cap base, and container body and including means for opening the sleeve to permit removal of the cap top. In one form, the flange extends downwardly from the shoulder a shorter distance than an adjacent portion of the sidewall of the cap top.

The container can include a film or other barrier attached to the top edge of the container body to seal the container opening. At least a portion of the film or barrier may be separable from a remainder of the film to form a dispensing opening in the film aligned with the opening of the cap base. In one form, the container includes a tamper-evident member removably attached to at least a portion of a perimeter of the opening of the cap base. The tamper-evident member may be attached to a portion of the film. The tamper-evident member is configured to separate from the portion of the perimeter of the opening of the cap base to remove at least a portion of the film to form the dispensing opening in the film. The cap base can be sealed relative to the top edge of the container via the film.

In an approach, at least a portion of the spout extends above the top edge of the wall of the cap base. The funnel can extend radially in a downward direction toward the bottom edge of the wall of the cap base and the funnel is oriented at an angle of at least 15 degrees relative to a horizontal plane. The container opening and the opening of the cap base each can have a central axis passing therethrough and the central axis of the opening of the cap base is offset from the central axis of the container opening.

The funnel can have a tear-drop shape oriented such that the liquid concentrate is directed onto a dispensing surface of the spout through an apex of the tear-drop.

In another approach, the sidewall of the cap top includes at least one visual indicator for use in measuring liquid concentrate in the cap top and the side wall of the cap top is at least in part transparent such that the at least one visual indicator is visible from both sides of the sidewall of the cap top.

Optionally, no portion of the cap base passes through the container opening into the interior of the container. The wall of the cap base can be curved from the top edge of the cap base to the bottom edge of the cap base and extends outwardly in a direction from top to bottom relative to a central longitudinal axis of the container. The container as described herein can be combined with a liquid concentrate.

In one form, the outer seal may formed between a distal end or landing of the shoulder of the cap top and a top edge of the wall of the cap base. In another form, the outer seal may be formed between the outer thread of the flange of the cap top and the inner thread of the wall of the cap base. In yet another form, the outer seal can be formed in both locations.

A method of dispensing the liquid concentrate from the above-described container is provided. In one form, the method includes removing the cap top from the cap base to unseal the first seal and the second seal and pouring the liquid concentrate from the interior of the container body through the opening of the cap base and into the cap top interior to a level indicator. The method may further include collecting into the channel liquid concentrate dripping on the sidewall of the cap top above the channel following the pouring of the liquid concentrate into the cap top interior. The method may also include removing a portion of a film sealing the container body from within the opening of the cap base to form a dispensing opening in the film. The method may also include separating a tamper-evident member, the tamper-evident member being at least in part attached to a portion of the funnel and to a portion of the film and surrounded by the spout, in a direction away from the dispensing surface of the spout to form the dispensing opening in the film.

DETAILED DESCRIPTION

A container for dispensing a liquid concentrate comprises a container body, a cap base sealed relative to the container body, and a cap top for sealing the container body threadingly engaged to the cap base. The cap base is adapted for collecting inadvertently dripped liquid and guiding it back into the container. The cap base also includes a channel adapted to collect liquid concentrate that drips from the spout of the cap base at or near the top of the outer sidewall of the cap top. When the container is closed, the cap top provides a dual seal for the container body via its threaded connection to the cap base and via the bottom edge of its sidewall being positioned in contact with an upper facing surface of the cap base. The threads of the cap top are located outside of the channel to restrict the liquid concentrate collected in the channel from coming into contact with the threads of the cap top.

Figure 1:
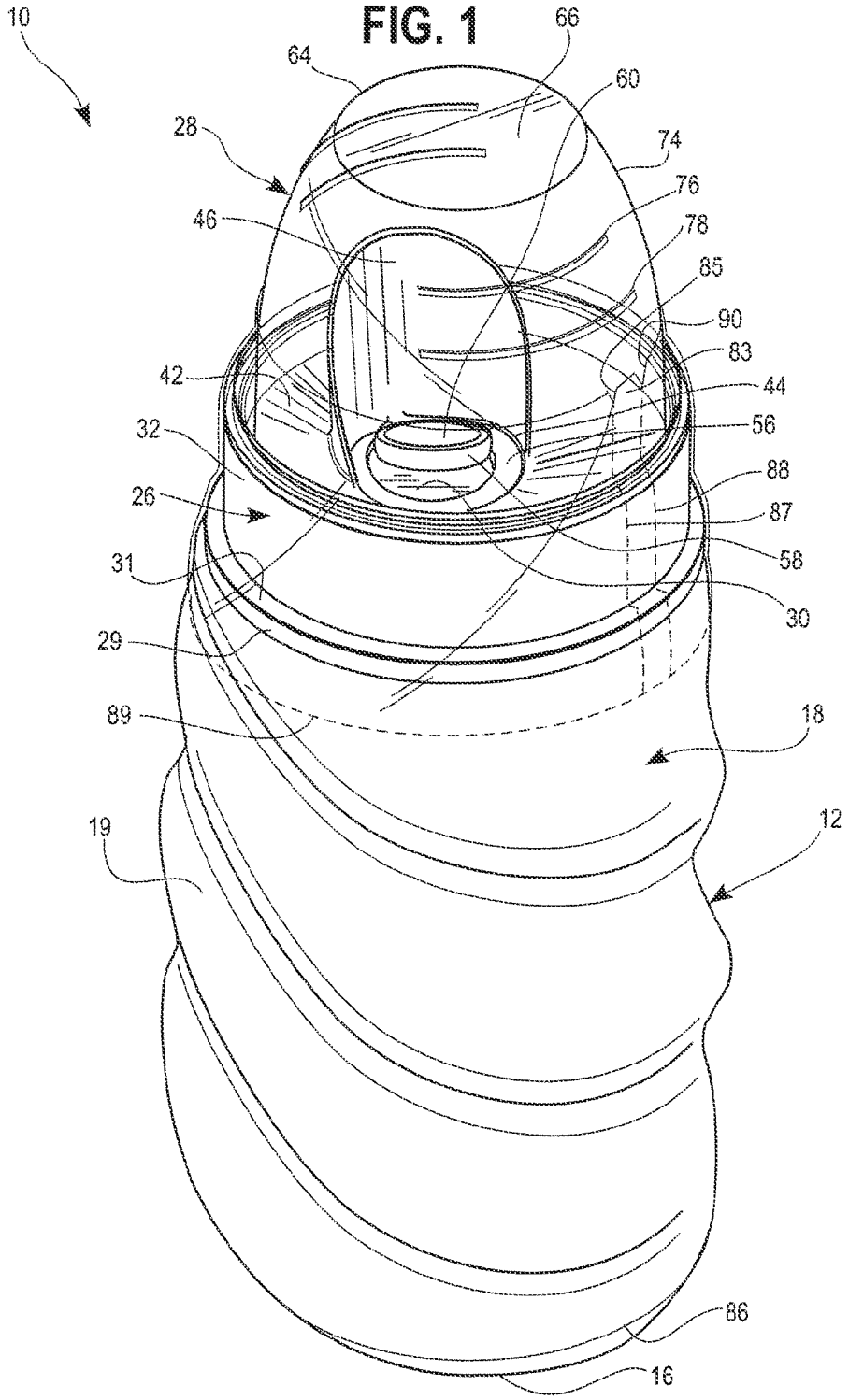
FIG. 1 illustrates a side perspective view of one form of a container shown in a closed position with the cap top attached to the cap base and shrink wrap.
Figure 2:
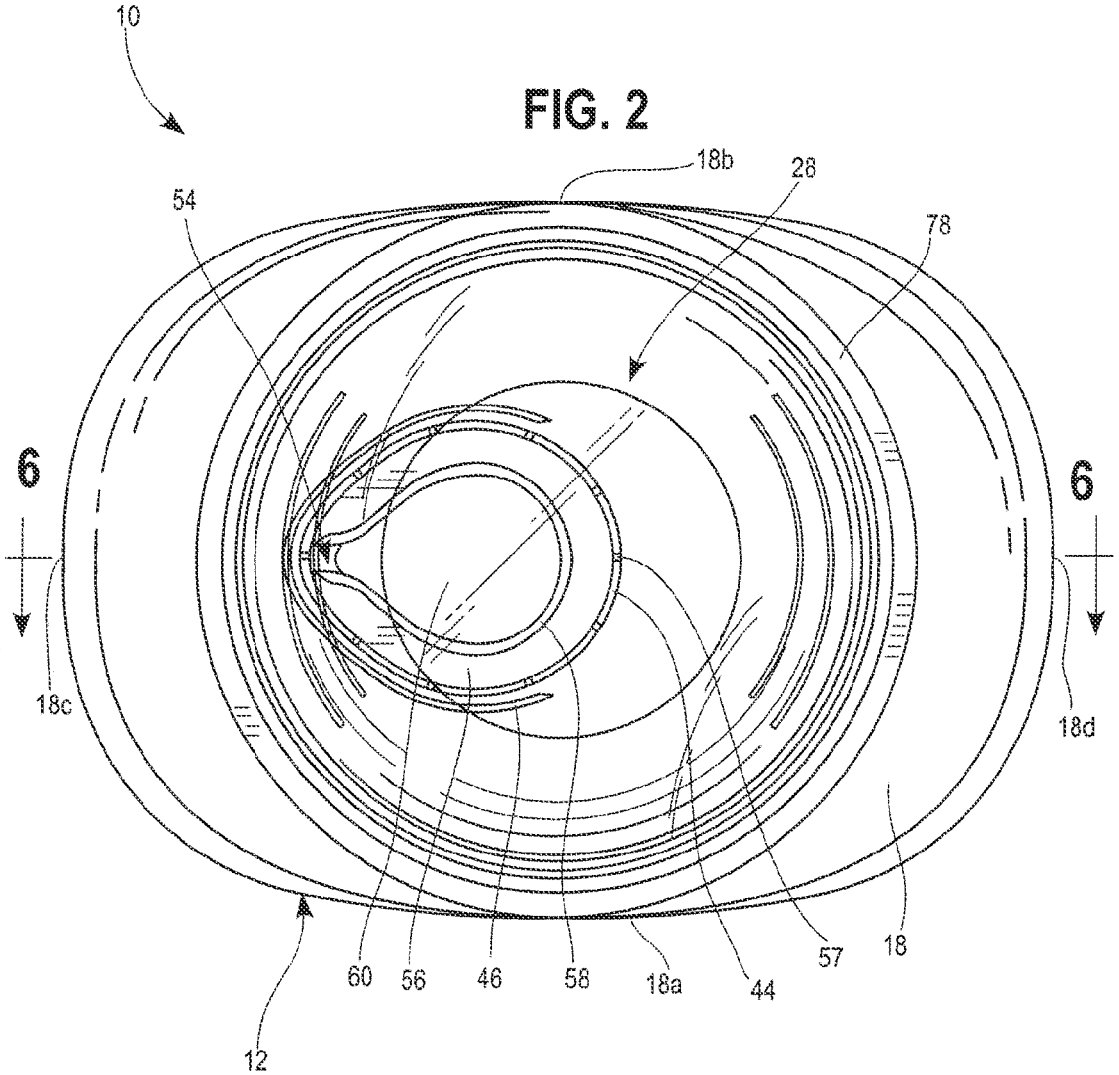
FIG. 2 illustrates a top plan view of the container of FIG. 1.
Figure 3:
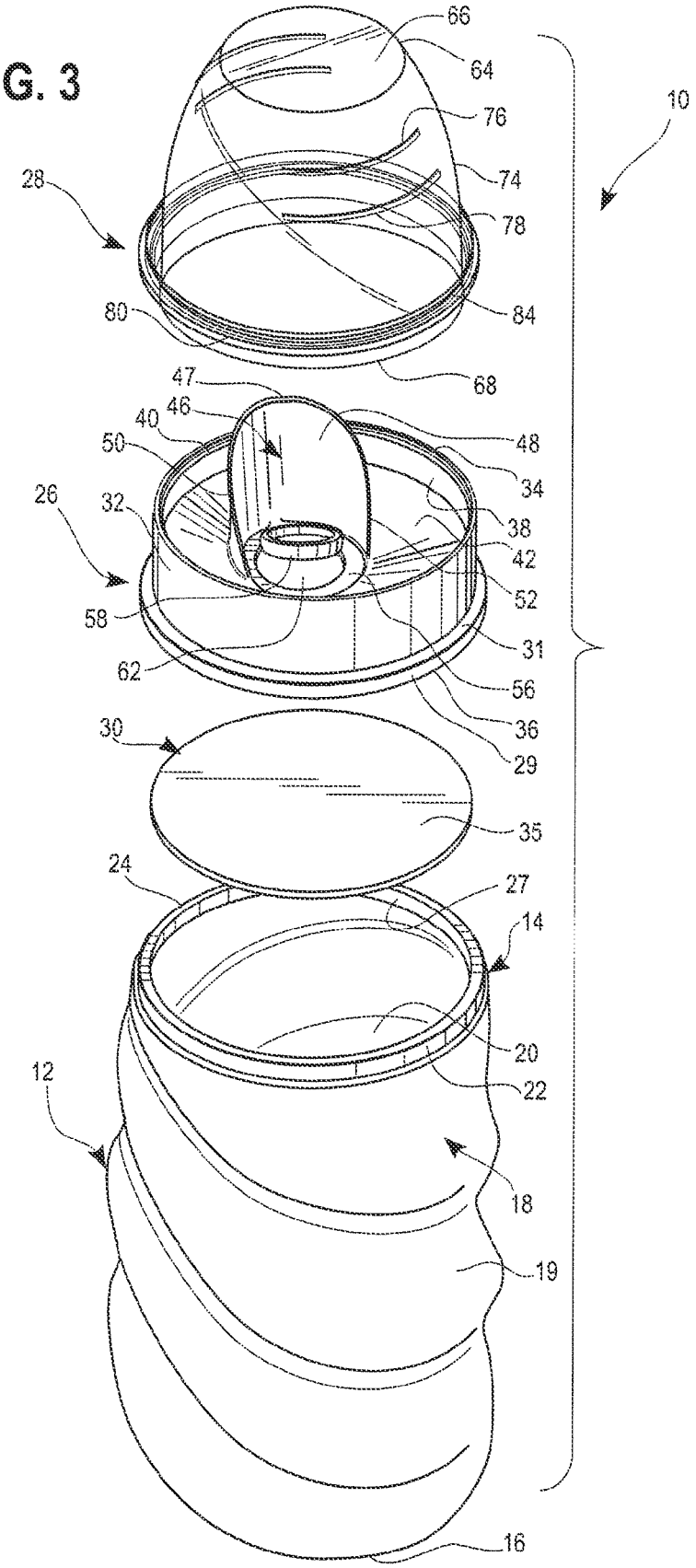
FIG. 3 illustrates a side perspective exploded view of the container of FIG. 1.

One form of a container 10 for storing and dispensing a liquid concentrate is shown in FIGS. 1-3. The container has a container body 12 having a top end 14, a bottom end 16, and a sidewall 18 connecting the top end 14 and the bottom end 16. The top end 14 of the container body 12 includes a container neck 22 and a top edge 24 surrounding a container opening 27. The sidewall 18 defines a hollow interior 20 of the container body 12 where the liquid concentrate may be stored. The sidewall 18 has a generally oblong cross-section such that the front and rear faces 18*a* and 18*b* of the sidewall 18 are wider than its first and second sides 18*c* and 18*d*, as illustrated in FIG. 2. It is to be appreciated that the sidewall 18 of the container body 12 may have a cross-section of any other shape, for example, circular, square, or triangular. The container body 12 may be formed from a variety of materials, in one approach, one or more plastic materials, for example, high-density polyethylene, high-density polypropylene, or the like.

In one approach, the liquid concentrate stored in the interior 20 of the container body 12 is suitable to provide a ready-to-drink ("RTD") beverage when mixed with a liquid, for example, water. In one form, the liquid concentrate may be potable such that it can be consumed by a user without mixing with another solution. In another form, the liquid concentrate may be non-potable (e.g., due to high acidity and/or intensity of the flavour in the liquid concentrate), but can be mixed with water and/or another potable liquid, for example, juice, soda, tea, coffee, and the like, to provide a RTD beverage. In one aspect, the liquid concentrate can be added from the container 10 to a potable liquid without stirring, and in another aspect, the liquid concentrate can be added to the potable liquid with stirring. The container 10 may also store any suitable powder that may be dispensed from the container 10 into water, juice, soda, or the like to form a RTD beverage.

The container 10 includes a cap base 26 sealed relative to the top edge 24 of the container body 12 and a cap top 28 removably attached to the cap base 26. In the form depicted in FIGS. 1 and 3, the cap base 26 is attached relative to the container body 12 such that the cap base 26 is neither detachable from nor rotatable relative to the container body 12. In one approach, the cap base 26 is attached to the top edge 24 of the container body 12 by welding, for example, ultrasonic welding, heat sealing, or the like.

Figure 6:
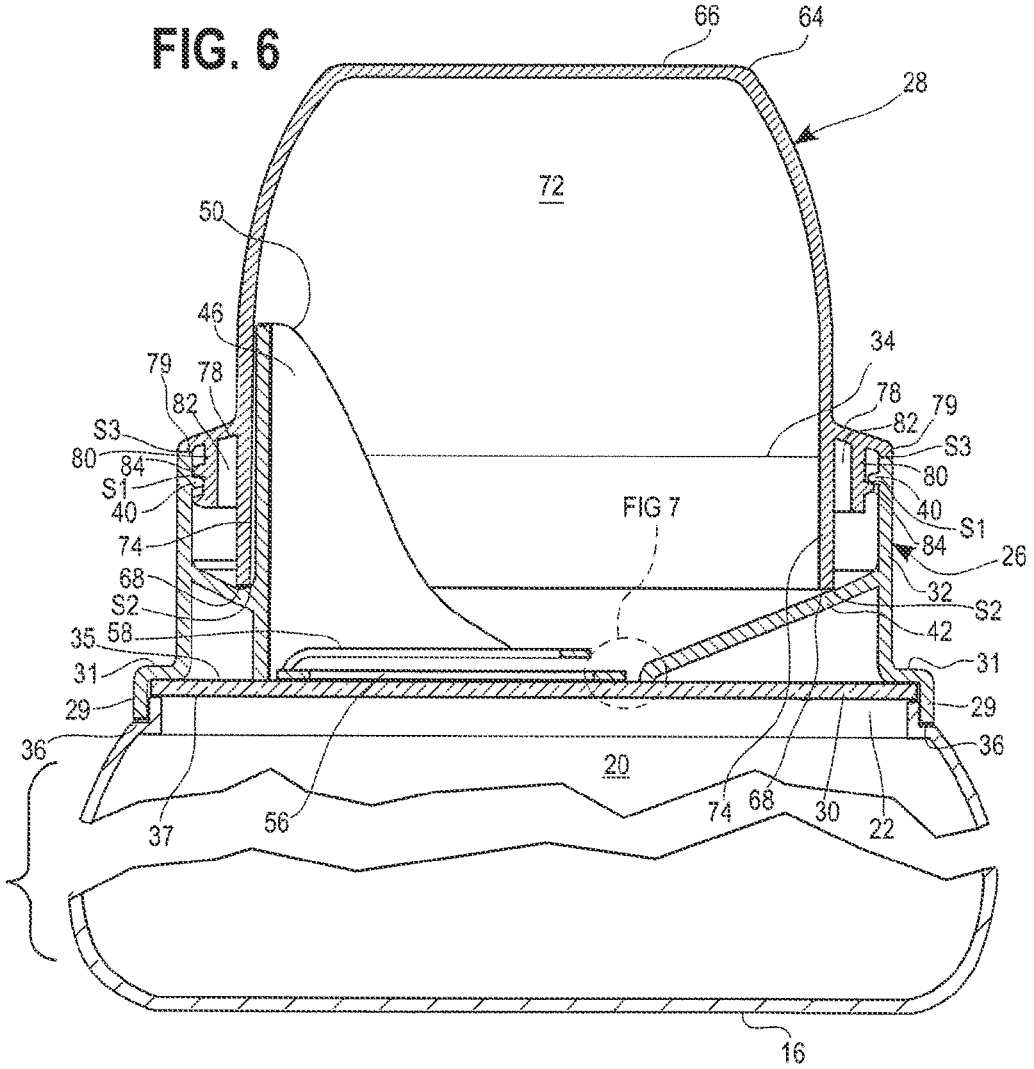
FIG. 6 illustrates a front elevation sectional view of the cap top, the cap base, sealing film, and relevant portions of the container of FIG. 1, including the bottom of the container being shown broken away.
Figure 7:
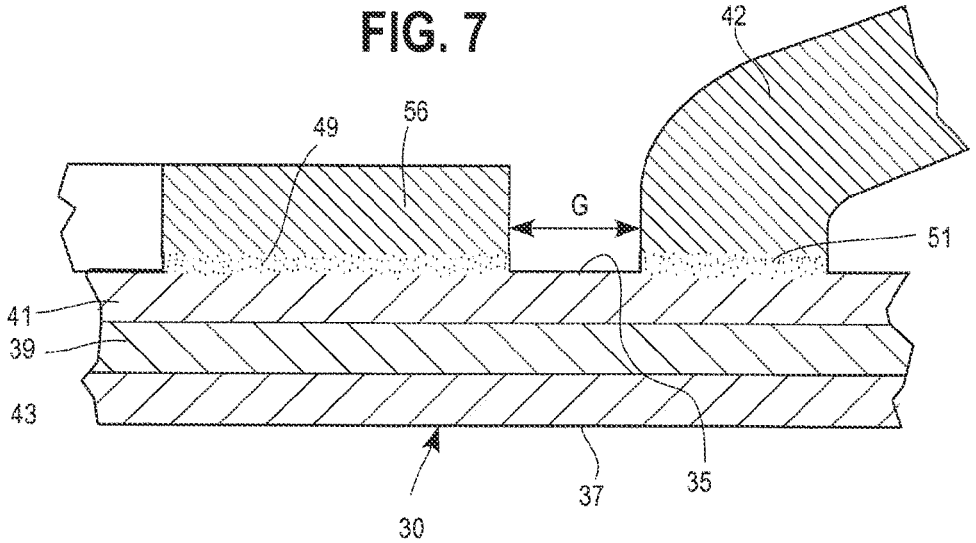
FIG. 7 illustrates an enlarged fragmentary view of portions of the cap base and the sealing film, showing the layers of the sealing film.

The container 10 includes a film 30 attached to the top edge 24 to seal the interior 20 of container body 12, as depicted in FIG. 6. The film 30 may be attached to the top edge 24 of the container body 12 by heat sealing, welding, ultrasonic welding, adhesives, or any other suitable means. The film 30 may be made from a material including a metallic layer, for example, an aluminum foil laminate. In one approach, the film 30 can include a pair of outer sealant layers 41 and 43 and a metalized layer 39 therebetween, as shown in FIG. 7. The outer sealant layers 41 and 43 can include polyethylene, polypropylene, or the like, while the metalized layer 39 can include aluminum. While the film 30 is sealed to the top edge 24 of the container body 12, the cap base 26 is sealed relative to the top edge 24 of the container body 12 via the film 30, as shown in FIG. 6. More specifically, a lower surface 37 of the film 30 is welded or heat-sealed to the top edge 24 of the container body 12 and a rim 31 of the cap base 26 is welded or heat-sealed to the upper surface 35 of the film 30, generally along the top edge 24 of the container body 12. It will be appreciated that the container 10 may be configured without the film 30 such that the cap base 26 is sealed, for example, by welding or heat-sealing, directly to the top edge 24 of the container body 12.

With reference to FIG. 3, the cap base 26 includes a wall 32 having a top edge 34 and a bottom edge 36. While the cap base 26 has been shown as being circular and the wall 32 as annular, it will be appreciated that the cap base 26 and the wall 32 can each be in a shape other than a circle, for example, oval, oblong, rectangular, square, or the like to accommodate a wide variety of container and container neck shapes. In the form depicted in FIGS. 3 and 6, the wall 32 has an inner-facing surface 38 and an inner thread 40. In one approach, the inner thread is positioned proximate the top edge 34 of the annular wall 32, as shown in FIG. 3.

With reference to FIGS. 1, 3, and 6, the cap base 26 includes a lip 29 that extends downward from a rim 31 surrounding the wall 32 of the cap base 26 and includes the bottom edge 36 of the cap base 26. When the cap base 26 is attached to the container body 12 as shown, for example, in FIG. 6, the rim 31 sits on top of and is sealed (e.g., by heat-sealing or welding) relative to the top edge 24 of the container body 12. In particular, the rim 31 is sealed to the upper surface 35 of the film 30 and the lower surface 37 of the film 30 is in turn sealed (e.g., by heat-sealing or welding) to the top edge 24 of the container body 12.

The lip 29 of the cap base 26 covers the top edge 24 and the neck 22 of the container body 12, as shown in FIG. 1. While the lip 29 has been shown as fully covering the neck 22 of the container body 12, the lip 29 may cover the neck 22 only in part. When the cap base 26 is sealed relative to the top edge 24 of the container body 12 as described in more detail above, the film 30 covers the opening 27 of the container body 12 and no portion of the cap base 26 is located within the neck 22 or the in the interior 20 of the container body 12, as shown in FIG. 6. In particular, the lip 29 of the cap base 26 surrounds the neck 22 while both the rim 31 and the wall 32 of the cap base 26 are exterior to the neck 22 and do not extend into the interior 20 of the container body 12. It is to be noted that this is not because the film 30 prevents the cap base 26 from extending into the neck 22 or the interior 20 of the container body 12. For example, if the container 10 were made without the film 30, no portion of the cap base 26 would extend into the neck 22 or the interior 20 of the container body 12.

It will be appreciated that the container 12 may be optionally configured such that the cap base 26 is detachable from and/or rotatable relative to the container body 12. For example, the cap base 26 may be in a friction fit with the neck 22 of the container body 12 such that the cap base 26 would not move or rotate during normal dispensing of the liquid concentrate from the container 10, but could be detachable from the container body 12 if a stronger force is applied, for example, to remove the cap base 26 for cleaning and/or washing purposes. In addition, while the cap base 26 has been depicted as being attached to a flat top edge 24, the cap base 26 may be configured to removably attach to a container with a neck having a top edge that is at least in part convex or concave.

With reference to FIGS. 1, 3, and 6, the cap base 26 further includes a funnel 42 surrounding an opening 44 of the cap base 26 that is in fluid communication with the interior 20 of the body of the container 12 when a portion of the film 30 underlying the opening 44 is removed. The funnel 42 provides a "drain-back" function and directs the liquid concentrate coming into contact (e.g., by dripping or inadvertent spilling) with the funnel 42 back through the opening 44 of the cap base 26 and into the interior 20 of the container body 12, as will be described in more detail below.

The funnel 42 extends radially inwardly in a downward direction toward the bottom edge 36 of the annular wall 32 of the cap base 26. The funnel 42 can be positioned relative to a horizontal plane at an angle sufficient to permit the liquid concentrate inadvertently dripping onto the funnel 42 (when a consumer dispenses the liquid concentrate from the interior 20 of the container body 12 into the cap top 28) to flow down the funnel 42 and through the opening 44 into the container interior 20. Preferably, the funnel 42 is oriented at least 5 degrees to the horizontal plane, more preferably, at least 10 degrees to the horizontal plane, and even more preferably, at least 15 degrees to the horizontal plane. In one approach, an inclination angle of the funnel 44 relative to the horizontal is between 5 and 60 degrees, more preferably between 10 and 45 degrees, and even more preferably, between 15 and 35 degrees.

With reference to FIGS. 1, 3, and 6, the cap base 26 also includes a spout 46 extending upwardly from the funnel 42. In the illustrated form, the spout 46 has a top edge 47 and extends above the top edge 34 of the annular wall 32 of the cap base 26 such that when the liquid concentrate is poured from the container 10 via the spout 46, the spilling of the liquid concentrate from the top edge 47 of the spout 46 onto the cap base 26 can be reduced or eliminated. The spout 46 has an interior-facing dispensing surface 48 at least partially in a form of a chute for receiving and guiding the liquid concentrate as it is being dispensed from the container body 12 and down the spout 46. In the illustrated form, the dispensing surface 48 of the spout 46 is entirely concave, but it will be appreciated that the dispensing surface 48 of the spout 46 can be concave only in part, or not concave at all. For example, the spout 46 may be in the form of two converging planes that meet at a point.

The opening 44 surrounded by the funnel 42 has a perimeter with a tear-drop shape, as shown in FIG. 7. The shape of the opening 44 is such that a preferable pour point or area is provided that facilitates the liquid concentrate being poured from the container body 12 to be directed through a narrowed portion 45 of a perimeter of the opening 44 and onto a dispensing surface 48 of the spout 46. As can be seen in FIG. 7, the opening 44 of the cap base 26 is offset from a center of the cap base 26 such that a central longitudinal axis passing through the opening 44 would be offset from a central axis of the cap base 26 and closer to one side of the perimeter of the opening 44 than to the opposite side of the perimeter of the opening 44, which can facilitate directional stream accuracy and improve flow control. As can be seen in FIG. 3, the central axis of the opening 44 is also offset from a central longitudinal axis passing through the container opening 27.

The spout 46 partially surrounds the opening 44 to permit the liquid concentrate to flow down the funnel 42 and through the opening 44, as shown, for example, in FIGS. 3 and 7. In form, the spout 46 may surround less than half of the perimeter of the opening 44, in another form, the spout 46 may surround more than half of the perimeter of the opening 44. In one form, the spout 46 may circumferentially extend around the opening 44 from 0 to 120 degrees, in another form, from 0 to 180 degrees, and in yet another form, from 0 to 240 degrees. The spout 46 has two free ends 50 and 52 with a gap therebetween, as shown in FIG. 3. The gap between the free ends 50 and 52 of the spout 46 is dimensioned to permit a user to insert at least one finger through the gap, for purposes that will be described below. Optionally, the gap may be too small to permit a user's finger to laterally pass therethrough, requiring the user to insert a finger into the spout 46 from above.

The cap base 26 may be formed from a variety of materials. In one approach, the cap base 26 is made from the same material or materials as the container body 12, in another approach, the cap base 26 is made from at least one different material than the container body 12. For example, the cap base 26 may comprise one or more plastic materials such as high-density polyethylene, high-density polypropylene, or the like. In one aspect, the spout 46 of the cap base 26 includes a surface that restricts dripping of the liquid concentrate, for example, from the top edge 47 or the side edges 50 and 52 of the spout 46. For example, the spout 46 may be coated with one or more materials that can reduce drip of the liquid concentrate when the liquid concentrate is poured from the spout 46 into a receptacle. For example, such materials can include the addition of slip additives in the resin for the cap base 26, silicon coating, and a very smooth finish.

The cap top 28 is removably attached to the cap base 26 to additionally seal the container body 12 and to cover the spout 48 and the opening 44 of the cap base 26, as shown in FIG. 2. When the cap top 28 is attached to the cap base 26, a hollow interior 72 of the cap top 28 is advantageously sealed from external contaminants. In the illustrated form, the cap top 28 is generally dome-shaped, but the cap top 28 may be of any other shape (e.g., square, rectangular, oblong, triangular, or the like) to match a variety of container shapes. The cap top 28 has a closed top end 64. The top end 64 includes a flat or straight portion 66, as shown in FIG. 6. It will be appreciated that the entire top end 64 may be curved. The flat portion 66 permits the cap top 28 to be stably positionable on a flat surface such as a table for dispensing the liquid concentrate from the container body 12 into the hollow interior 72 of the cap top 28.

Figure 4:
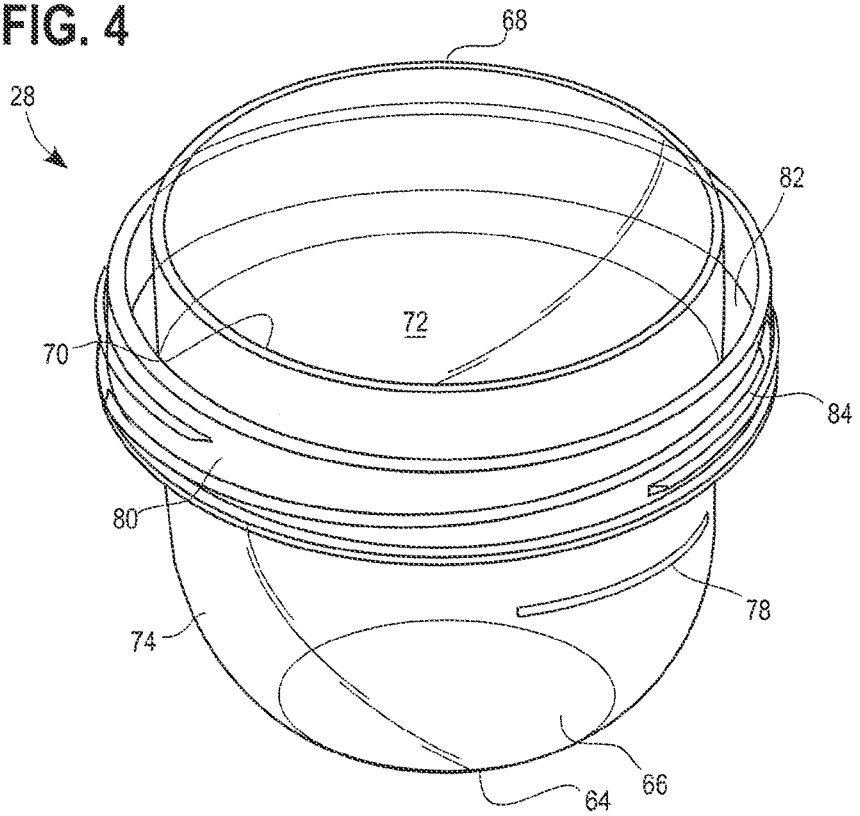
FIG. 4 illustrates a bottom perspective view of the cap top of FIG. 1.
Figure 5:
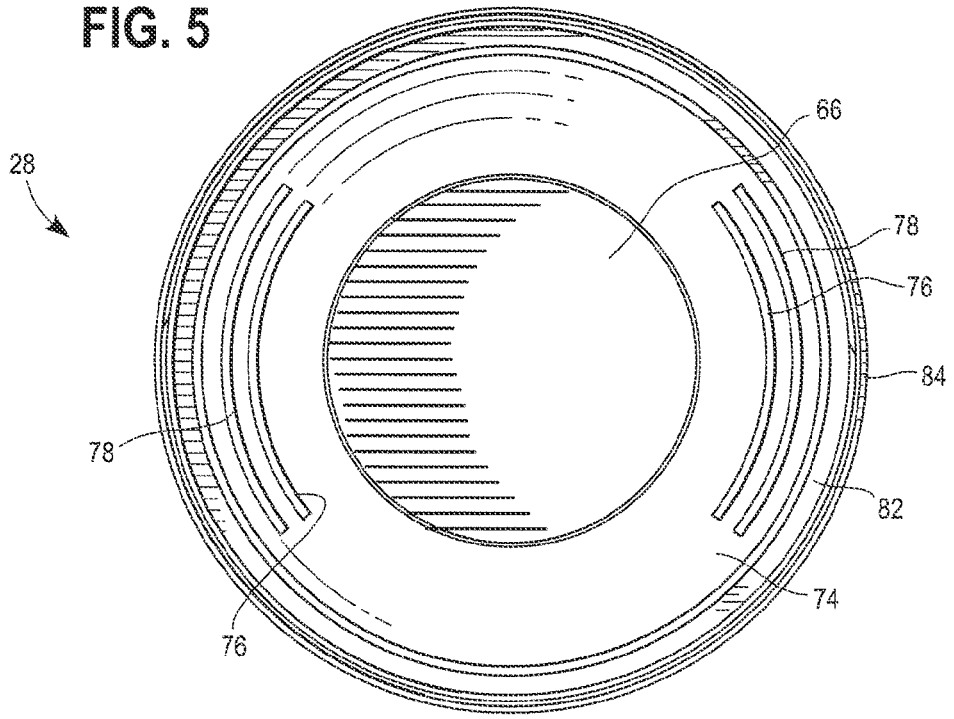
FIG. 5 illustrates a top plan view of the cap top of FIG. 1.

With reference to FIGS. 3 and 4, the cap top 28 further includes a bottom edge 68 surrounding an opening 70 into the hollow interior 72 of the cap top 28 and a sidewall 74 extending between the top end 64 and the bottom edge 68 and surrounding the hollow interior 72. In the form depicted in FIG. 4, the hollow interior 72 of the cap top 28 extends from the top end 64 to the bottom edge 68 for receiving a predetermined volume of the liquid concentrate from the interior 22 of the container body 12. While the hollow interior 72 is being described as receiving the liquid concentrate from the container body 12, the interior 72 of the cap top 28 can also receive a liquid (e.g., water, juice, soda, or the like) or a solid material (e.g., a powder for mixing with the liquid concentrate. While the hollow interior 72 of the cap top 28 has been shown in FIGS. 4 and 6 as being surrounded by one sidewall 74, it is to be appreciated that the cap top 28 may include a second wall spaced inwardly from the sidewall 74 and forming a generally cylindrical cavity in the cap top 28 for receiving the liquid concentrate from the container body 12.

With reference to FIG. 6, the cap top 28 includes an outwardly extending shoulder 78 extending about the sidewall 74 of the cap top 28. The shoulder 78 includes a flange 80 depending downwardly therefrom. When measured relative to the position of the shoulder 78, the flange 80 extends downwardly toward the bottom edge 68 of the cap top 28 a shorter distance than an adjacent portion of the sidewall 74 of the cap top 28. In other words, the portion of the sidewall 74 extending past the shoulder 78 toward the bottom edge 68 of the cap top 28 is longer than the flange 80, as shown in FIG. 6.

The shoulder 78, the flange 80, and the portion of the sidewall 74 opposite the flange 80 define a channel 82 for collecting the liquid concentrate that inadvertently drips or spills onto the sidewall 74 of the cap top 28. In particular, when a consumer pours the liquid concentrate into the hollow interior 72 of the cap top 28 (which is positioned with its bottom edge 68 facing in the upward direction), it is possible that some liquid concentrate may drip or spill on the bottom edge 68 or the sidewall 74 proximate the bottom edge 68. The channel 82 is advantageously positioned such that the spilled liquid concentrate may be directed down the sidewall 74 and into the channel 82. As such, the channel 82 can restrict and/or prevent the liquid concentrate from dripping down the sidewall 74 onto a surface (e.g., table, chair, couch, consumer's clothing, or the like) where the liquid concentrate may create an undesirable stain.

Advantageously, the flange 80 has threads 84 that are located on an exterior surface of the flange 80. Accordingly, the threads 84, which engage the inner threads 40 of the cap base 26 when the cap top 28 is secured to the cap base 26, are not located in the collecting channel 82, and do not come into contact with the liquid concentrate when the latter drips down the sidewall 74 into the collecting channel 82. The present approach is unlike the known cap tops which are configured such that the threads of the cap top are located on an interior surface of the flange and thus in the channel, where they routinely come into contact with the liquid concentrate dripping into the collecting channel. When such cap tops are secured to the container via a threaded engagement, the liquid concentrate (which may be perceived as being sticky by consumers) can be transferred from the threads of the cap top onto the threads of the container, which is not desirable at least because this may cause the cap top to stick to the container at the threaded interface. As such, the position of the threads 84 on the exterior of the flange 80 and outside of the collecting channel 82 advantageously restricts the threads 84 from being contacted by the liquid concentrate that drips into the collecting channel 82.

In the illustrated form, the cap top 28 is mounted on the container 10 by attaching to the cap base 26. Specifically, when the cap top 28 is mounted on the container 10 such that the container 10 is closed, the outer threads 84 of the flange 80 of the cap top 28 engage the inner threads 40 of the wall 32 of the cap base 26 such that a first seal S1 is formed between the inner threads 40 of the cap base 26 and the outer threads 84 of the cap top 28 such that the liquid concentrate is restricted from flowing past the interface between the threads 40 and the threads 84, as shown in FIG. 6. Further, the cap top 28 is attached to the cap base 26 such that the bottom edge 68 of the sidewall 74 of the cap top 28 engages an upwardly-facing surface of the funnel 42 to create a second seal S2, as shown in FIG. 6. When the threads 40 of the cap base 26 and the threads 84 of the cap top 28 are fully engaged, a landing 79 of the shoulder 78 of the cap top 28 may engage the top edge 34 of the cap base 26 to form a seal S3, as shown in FIG. 6. While the container 10 has been shown with three seals S1, S2, and S3 in FIG. 6, it will be appreciated that S1 and S3 can be alternative optional seals. In other words, the cap top 28 is configured such that it can sufficiently seal the container 10 when two seals are present.

For example, the cap top 28 can sufficiently seal the container 10 when either S1 and S2 are present or when S2 and S3 are present.

The first and second seals S1 and S2, with, or without the optional third seal S3, can advantageously further seal the liquid concentrate in the container 10 and maintain a previously opened container 10 (i.e., where the film 30 does not fully seal the opening 22 of the container interior 20) in an upside down orientation for several minutes without any liquid concentrate leaking out of the cap top 28. In addition, the presence of the second seal S2 between the bottom edge 68 of the sidewall 74 and the upwardly facing surface of the funnel 42 can restrict the liquid concentrate from leaking from the interior 20 of the container body 12 into the interface between the threads 40 of the cap base 26 and the threads 84 of the cap top 28 and soiling the threads 40 and 84.

When the cap top 28 is mounted onto the container 10, the cap top 28 is fully outside of the interior 20 of the container body 12, as shown in FIG. 6. In other words, no portion of the cap top 28 is located in the interior 20 of the container body 12 when the cap top 28 is mounted on the container 10. FIG. 6 also shows that when the cap top 28 is mounted onto the container 10, no portion of the cap top 28 contacts the container body 12. This is unlike the known cap tops, which typically require the container body 12 to have a neck having external threads and attach directly to the neck via a threaded connection.

To facilitate dispensing a predetermined amount of the liquid concentrate into the cap top 28, the sidewall 74 of the cap top 28 is transparent, as shown in FIG. 4. The sidewall 74 may include one or more indicators 76, 78 for indicating to a user that a predetermined level of the liquid concentrate for a particular use has been reached in the interior 72 of the cap top 28. As such, the cap top 28 provides a measuring cup for the container 10. For example, one indicator 76 may be selected to indicate that an amount of liquid concentrate sufficient for an 8 oz. glass of RTD has been poured into the cap top 28, and another indicator 78 may be selected to indicate that liquid concentrate sufficient for a quart of RTD has been poured into the cap top 28. The level indicators 76 may be in the form of printed markings or surface deviations (e.g., etching, ribs, or the like). Since the exemplary cap top 28 is transparent, the level indicators 76 may be located and are visible when on either the interior or exterior surface of the sidewall 74. In one approach, the cap top 28 may be opaque, and the level indicators 76 may be positioned on the interior surface of the sidewall 74 so that they are visible to a consumer when pouring the liquid concentrate into the cap top 28. As discussed above, the top end 64 of the cap top 28 includes a flat portion 66 that permits the cap top 28 to be stably positioned on a flat surface during the pouring operation, allowing the user to pour the liquid concentrate from the container 10 into the cap top 28 while using only one hand.

The cap top 28 may be formed from a variety of materials, in one approach, from the same material or materials as the container body 12 and the cap base 26, in another approach, from at least one different material than the container body 12 and the cap base 26. For example, the cap top 28 may comprise one or more plastic materials such as high-density polyethylene, high-density polypropylene, or the like.

The sidewall 18 of the container body 12 includes a plurality of surface deviations in an exterior surface of the sidewall 18 of the container body 12. A plurality of grooves 19 spiral about the sidewall 18 of the container body 12 as shown in FIGS. 1 and 3. The grooves 19 rotate at least one full turn about the sidewall 18 and are dimensioned to partially receive the fingers of a user for gripping the container body 12. In another approach, the gripping means may include one or more indentations or notches dimensioned to receive one or more of the user's fingers for gripping the container body 12 can be permitted.

The grooves 19 are configured such that when the container body 12 is gripped by a consumer by placing his or her fingers partially into the grooves 19, the container body 12 and the spout 46 of the container 10 can be positioned in a preferred orientation for dispensing the liquid concentrate from the container 10. In one approach, the grooves 19 or indentations may be aligned with a longitudinal axis bisecting the opening 44 of the cap base 26, in another approach, the grooves 19 or indentations may be aligned to be offset from the longitudinal axis bisecting the opening 44 of the cap base 26, for example by 1-10 degrees.

The container 10 can optionally include removable tamper-evident features that permit a user to determine whether the container 10 has been previously opened and/or tampered with. The cap base 26 of the container 10 includes a removable tamper-evident member 54 which can be used to remove a part of the film 30 to unseal the interior 20 of the container body 12 and provide a dispensing opening 62 in the film 30, as shown in FIGS. 1, 3, 6, and 8. The exemplary tamper-evident member 54 includes a base 56 and a pull ring 58 hingedly or pivotally mounted relative to the base 56. The pull ring 58 includes an opening 60 where the consumer can insert a finger to grasp the pull ring 58. When the tamper-evident member 54 is present as shown in FIG. 1, the consumer must remove the tamper-evident member 54 in order to dispense the liquid concentrate from the container 10.

Figure 8:
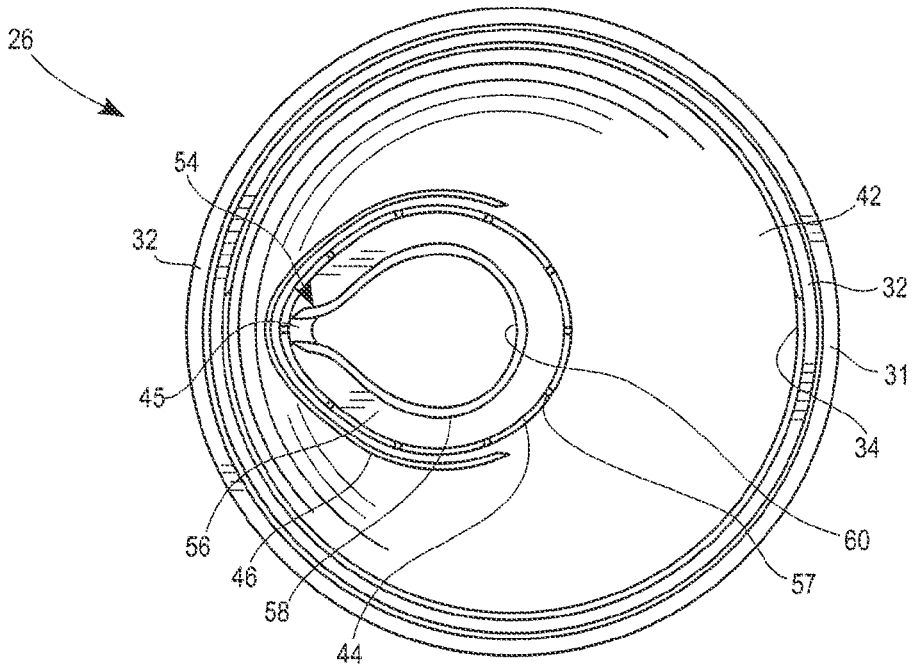
FIG. 8 illustrates top plan view of the cap base of FIG. 1.

The base 56 and the pull ring 58 of the tamper-evident member 54 have been shown as oblong and tear-shaped respectively, as shown in FIG. 8, but may be of any other shape (e.g., rectangular, triangular, trapezoidal, or the like) to optionally match the shape of the opening 44 in the funnel 42. The base 56 of the tamper evident member 54 is at least in part attached to a portion of the funnel 42 and to at least a portion of the film 30. In one form, one or more side edges along a perimeter of the base 56 of the tamper-evident member 54 are attached via connecting ribs 57 to the funnel 42, preferably at the perimeter of the opening 44, as shown in FIG. 8. Although the base 56 of the tamper-evident member 54 has been shown as being attached to the funnel 42 via the connecting ribs 57, which can allow the tamper-evident member 54 to be molded with the funnel 42, it will be appreciated that the base 56 can alternatively be attached to the film 30 and not the funnel 42. In another alternative, the base 56 may be attached by welding or heat-sealing to the perimeter of the opening 44 along part of or the entire perimeter of the base 56 such that the base 56 is removably secured to the funnel 42.

An underside of the base 56 of the tamper-evident member 54 is at least partly attached via the seal areas 49 and 51 (e.g., created by welding, heat-sealing, adhesives, or the like) to the upper surface 35 of the film 30 along a sealing perimeter, for example, along the perimeter of the opening 44, as shown in FIGS. 6 and 7. The attachment of the film 30 to the underside of the base 56 along the perimeter of the opening 44 permits a portion of the film 30 (preferably within the sealing perimeter) to be separated from the remainder of the film 30 to form a dispensing opening 62 in the film 30 in fluid communication with the opening 27 of the container body 12. Specifically, the upper surface 35 of the film is attached at the seal area 51 to the funnel 42 outside of the perimeter of the opening 44 and attached at the seal area 49 to the base 56 of the tamper-evident member 54 at, or within the perimeter of the opening 44, such the film 30 tends to have a weakened area in a gap G between the seal areas 49 and 51, as shown in FIG. 7. The removal of base 56 of the tamper-evident member 54, which overlies the opening 44, removes with it the portion of the film 30 attached to the base 56 at the seal area 49 located within the perimeter of the opening 44 to provide the dispensing opening 62 in the film 30 while another portion of the film 30 remains attached to the funnel 42 at the seal area 51 surrounding the dispensing opening 62.

In addition to the tamper-evident member 54 described above, the container 10 can be provided with a second tamper evident feature to indicate to a consumer whether the container 10 has been previously opened and/or tampered with. In the form illustrated in FIG. 1, the second tamper-evident feature of the container 10 is a shrink wrap 86, which is in a form of a sleeve that covers the container body 12, the cap base 26 and the cap top 28. The shrink wrap 86 fully covers the cap base 26 and partly covers the container body 12 and the cap top 28. It will be appreciated that the dimensions of the shrink wrap 86 have been shown in FIG. 1 for illustration purposes only, and that the shrink wrap 86 can extend further up toward the top end 64 of the cap top 28 and further down toward the bottom end 16 of the container body 12. For example, in one approach, the shrink wrap 86 can cover 25% of the container 10 from the top edge 64 of the cap top 28 to the bottom edge 16 of the container body 12. In alternative approaches, the shrink wrap 86 may cover 50%, 75%, 80%, or 90% of the container 10. In yet another approach, the shrink wrap 86 may fully envelope the container 10.

The shrink wrap 86 can be made of a flexible film material, for example, polyethylene terephthalate, a copolymerized polyethylene terephthalate, polyethylene terephthalate glycol, polyvinyl chloride, polypropylene, and polyethylene, or the like. The shrink wrap 86 can be made of a transparent material, as shown in FIG. 1. Optionally, the shrink wrap 86 can also be made of a material that is not transparent. The contours of the container body 12 of the container 10 are such that the shrink wrap 86 can be tightly wrapped around the container 10 such that the shrink wrap 86 is substantially immobilized relative to the container body 12 without the use of any adhesive material.

The shrink wrap 86 may be configured for opening to access the cap top 28 for purposes of opening the container 10, and may include one or more pull tabs, notches, score lines, and/or perforation lines. In the illustrated form, the shrink wrap 86 includes score lines 88, 87, and 89 that represent an intended path for opening the shrink wrap 86. The score lines 87 and 88 are vertical and generally parallel to each other and intersect the horizontal score line 89, which forms a ring around the sidewall 18 of the container body 12, as shown in FIG. 1. It will be appreciated that the score lines 87 and 88 do not have to be parallel to each other and may converge or diverge relative to each other. Similarly, the score lines 87 and 88 do not have to be perpendicular to the score line 89 and may be oriented relative to the score line 89 at an angle that is less than 90 degrees or more than 90 degrees.

With reference to FIG. 1, the shrink wrap 86 includes a pair of readily visible notches 85 and 90. The notches 85 and 90 are V-shaped and provide a pull tab 83 therebetween for initiating a tear line along the score lines 87 and 88 to facilitate the removal of the shrink wrap 86. For example, when a consumer grasps the pull tab 83 and pulls it in a downward direction, a pair of tear lines will propagate along the score lines 87 and 88. When the tear lines intersect the ring-like score line 89, a single tear line will propagate along the score line 89 to separate the portion of the shrink wrap 86 above score line 89. The removal of the shrink wrap 86 above the score line 89 provides the consumer access to the cap top 28 for opening the container 10 and allows the portion of the shrink wrap 86 to remain on the container, which may be advantageous if the shrink wrap 86 includes branding information. The contours of the container body 12 of the container 10 are such that the shrink wrap 86 can be substantially immobilized relative to rotation and/or axial movement in relation to the container body 12 even after the portion of the shrink wrap 86 above the score line 89 has been removed. Instead of the notches 85 and 90 and the score lines 87, 88, and 91 (which can be formed by ablation by a laser), the shrink wrap 86 may include one or more pull tabs, or lines of weakness other than score lines.

Figure 9:
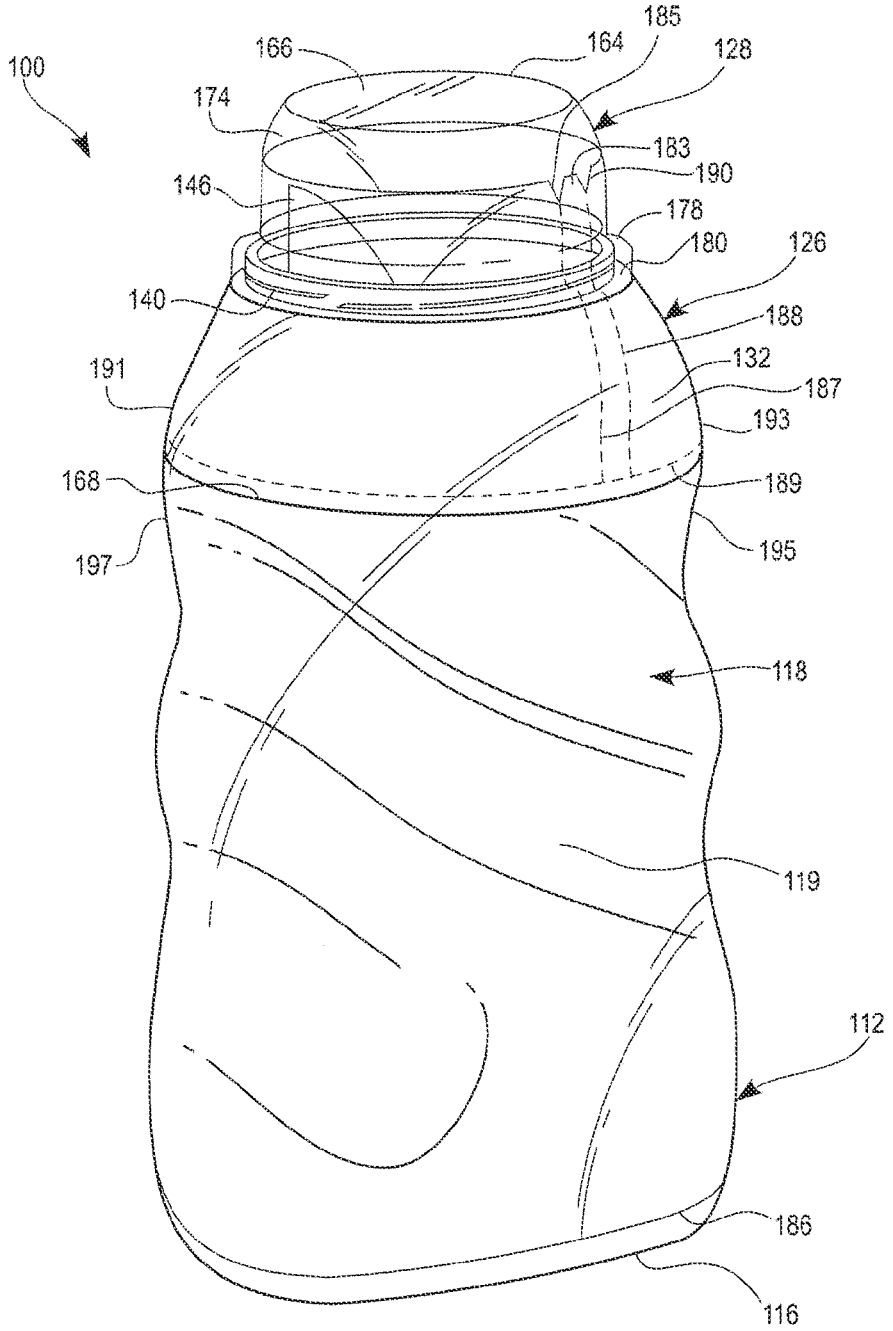
FIG. 9 a front perspective view of another form of a container shown in a closed position with a cap top attached to a skirted cap base and shrink wrap.
Figure 10:
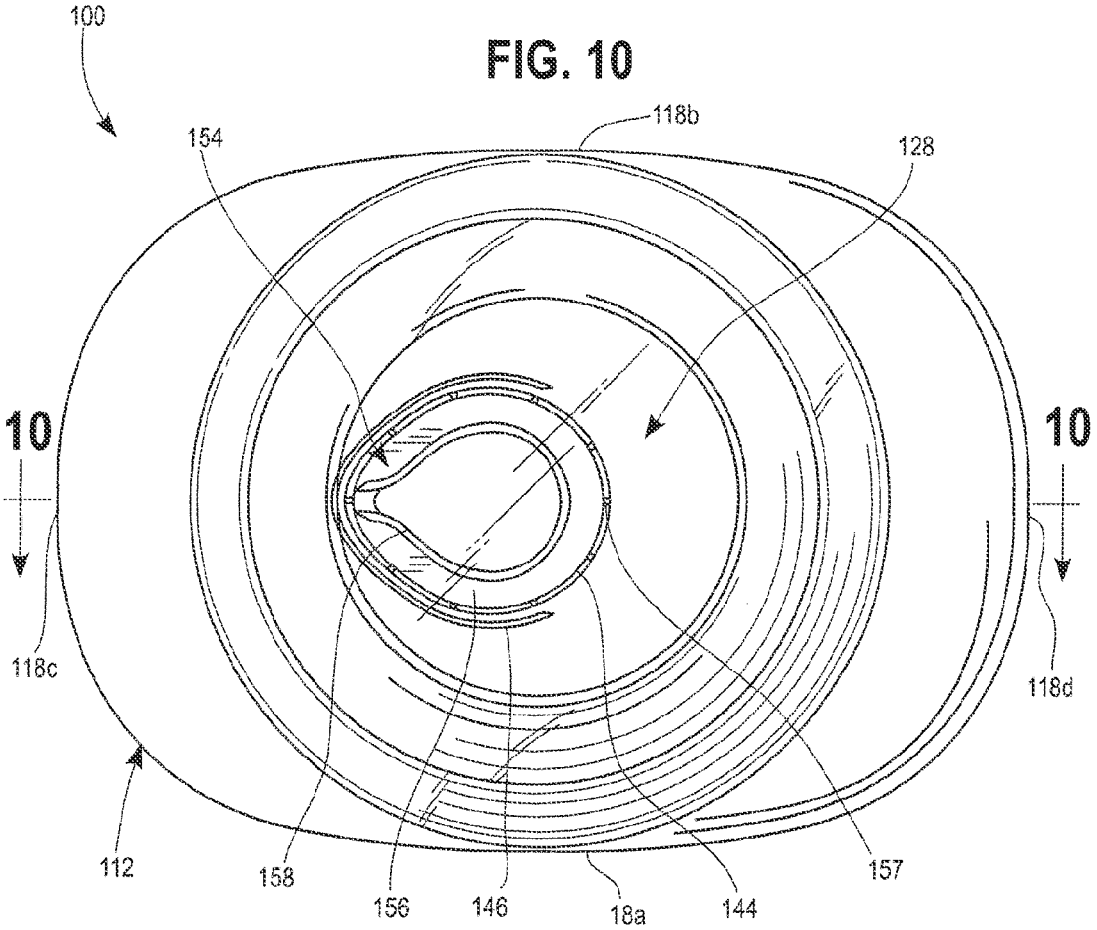
FIG. 10 illustrates a top plan view of the container of FIG. 1.
Figure 11:
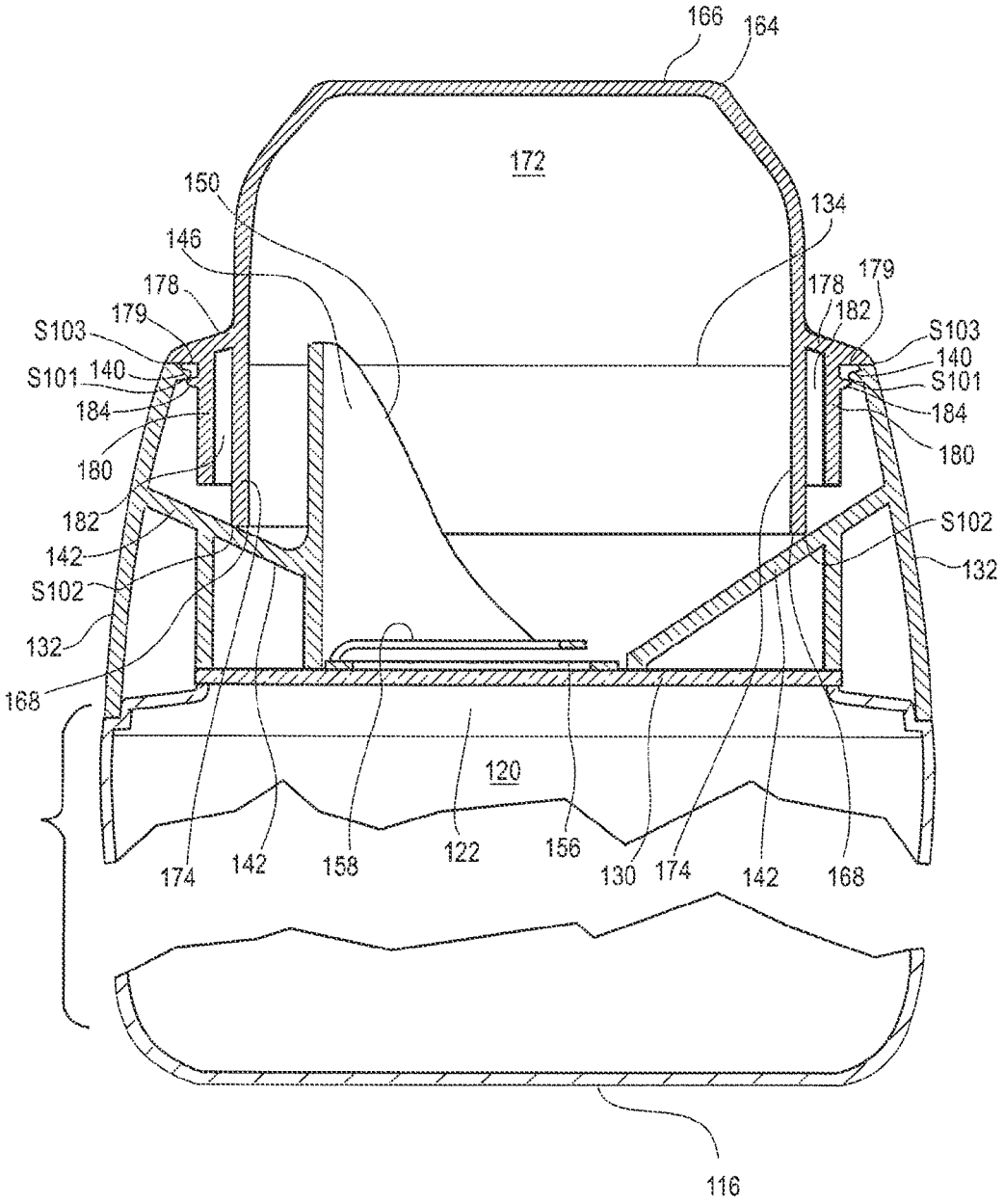
FIG. 11 illustrates a front elevation sectional view of the cap top, the cap base, and relevant portions of the container of FIG. 8, including the bottom of the container being shown broken away.

With reference to FIGS. 9-11, a container 100 according to another form is described. For ease of reference, in FIGS. 9-11, the aspects of the container 100 that are similar to the aspects of the container 10 have been designated with like reference numbers. The container 100 has a container body 112 that is substantially identical to the container body 12 of the container 10. The sidewall 118 of the container 100 has a generally oblong cross-section such that the front and rear faces 118*a* and 118*b* of the sidewall 118 are wider than its first and second sides 118*c* and 118*d*, as illustrated in FIG. 10. The container body 112 includes a grip means in the form of multiple surface deviations 119 that are identical to the grip means 119 of the container 10. The container 100 and its components such as the container body 112, the cap base 126, and the cap top 128 can be manufactured from identical materials as the container 10, described in more detail above.

The container 100 includes a shrink wrap 186 that is substantially identical to the shrink wrap 86 aside from a size variation to accommodate for the shape of a skirt-like wall 132 of the container 100, as shown in FIG. 9. The container 100 also includes a tamper-evident member 154 comprising a base 156 and a pull ring 158 substantially identical to the base 56 and the pull ring 58 of the tamper-evident member 54, as shown in FIG. 11. The container 100 includes a cap base 126 and a cap top 128, each of which is similar to the cap base 26 and the cap top 28 of the container 10.

With reference to FIG. 11, the cap base 126 includes a wall 132 that, unlike the wall 32 of the cap base 26 (which is annular and extends generally parallel along the central longitudinal axis of the container 10), is generally oblong in cross-section and is shaped in the form of an outwardly tapering skirt. When compared to the transition between the container body 12 and the lip 29 of the cap base 26, the skirt shape of the wall 132 allows the wall 132 to have a smoother transition with the surface deviations at the side portions of the sidewall 174, as shown in FIG. 9. As depicted in FIG. 9, the portions 191 and 193 proximate the bottom edge 168 of the wall 132 have generally matching curvatures to the portions 195 and 197 of the sidewall 118 of the container body 112 such that the overall container 100 appears to maintain a natural curvature from the top end 164 to the bottom end 116, which may be visually appealing to the consumers.

The cap base 126 has a bottom edge 136, which is sealingly attached relative to the neck 122 of the container 100 via the sealing film 130 as described in reference to FIG. 6. As shown in FIG. 11, the wall 132 covers the neck 122 of the container body 112, but may be configured to cover the neck 122 only in part. Similar to the cap base 26 of the container 10 and as shown in FIG. 11, when the cap base 126 is sealed relative to the neck 122 of the container body 112, the film 130 covers the opening of the container body 112, and no portion of the cap base 126 is located within the neck 122 or in the interior of the container body 112.

With continued reference to FIG. 11, the cap base 126 also includes a funnel 142 surrounding an opening 144. The opening 144 is in fluid communication with the interior of the container body 112 when a portion of the film 130 underlying the opening 144 is removed, as described in more detail with reference to the container 10. The funnel 142 is substantially similar in structure and function to the funnel 42, but the funnel 142 is longer due to the outwardly bowing skirted shape of the wall 133, as can be seen by comparing FIGS. 6 and 11. A spout 146, which is substantially identical to the spout 46, extends upwardly from the funnel 142.

The cap top 128 of the container 100 is substantially similar to the cap top 28 of the container 10, but has a lesser height as measured from its top end 164 to its bottom edge 168 to accommodate for the difference in the overall shape of the container 100 relative to the container 10. It will be appreciated that the height of the cap tops 28 and 128 has been depicted for illustration purposes only and that each of the cap tops 28 and 128 may have a greater height or a lesser height. Similar to the sidewall 74 of the cap top 28, the sidewall 174 of the cap top 128 is transparent and while the cap top 128 has been depicted without the level indicators such as 76 and 78, it will be appreciated that the sidewall 74 may include one or more such indicators.

Similar to the cap top 28, the cap top 128 includes an outwardly extending shoulder 178 extending about the sidewall 174 of the cap top 128. The shoulder 178 includes a flange 180 depending downwardly therefrom and has a distal end in a form of a landing 179, discussed in more detail below. When measured relative to the position of the shoulder 178, the flange 180 extends downwardly toward the bottom edge 168 of the cap top 128 a shorter distance than an adjacent portion of the sidewall 174 of the cap top 128. In other words, the portion of the sidewall 174 extending past the shoulder 178 toward the bottom edge 168 of the cap top 128 is longer than the flange 180, as shown in FIG. 11.

Similar to the corresponding structures of the container 10 in FIG. 1, the shoulder 178, the flange 180, and the portion of the sidewall 174 opposite the flange 180 define a channel 182 for collecting the liquid concentrate that inadvertently drips or spills onto the sidewall 174 when a consumer pours the liquid concentrate from the container body 112 into the cap top 28. Similar to the channel 82 described above, the channel 182 is advantageously positioned such that the spilled liquid concentrate would be directed down the sidewall 174 and into the channel 182. As such, the channel 182 restricts and/or prevents the liquid concentrate from dripping down the entire sidewall 174 onto a surface where the liquid concentrate may create an undesirable stain.

Similar to the flange 80 of the container 10, described in detail above, the flange 180 advantageously has threads 184 that are located on an exterior surface of the flange 180, and will not be described separately. Another similarity of the containers 10 and 100 is that the cap top 128 is mounted on the cap base 126 of the container 100 such that the outer threads 184 of the flange 180 of the cap top 128 engage the inner threads 140 of the wall 132 of the cap base 126 such that a first seal S101 is formed between the inner threads 140 and the outer threads 184. In addition, the cap top 128 is attached to the cap base 126 such that the bottom edge 168 of the sidewall 174 engages the upwardly facing surface of the funnel 142 to create a second seal S102. Similarly to the container 10, when the threads 140 of the cap base 126 and the threads 184 of the cap top 128 of the container 100 are engaged, the landing 179 of the shoulder 178 of the cap top 128 may engage the top edge 134 of the cap base 126 to form an optional seal S103, as shown in FIG. 11. Although the container 100 has been shown with three seals S101, S102, and S103, the double seal provided by S101 and S102 without S103 (or, in the alternative, the double seal provided by S102 and S103 without S101) can advantageously further seal the liquid concentrate in the container 100 and maintain a previously opened container 100 (i.e., where the film 130 does not fully seal the opening 122 of the container interior 120) in an upside down orientation for several minutes without any liquid concentrate leaking out of the cap top 128. In addition, the presence of the second seal S102 between the bottom edge 168 of the sidewall 174 and the upwardly facing surface of the funnel 142 can restrict the liquid concentrate from leaking from the interior 120 of the container body 112 into the interface between the threads 140 of the cap base 126 and the threads 184 of the cap top 128 and soiling the threads 140 and 184.

The containers 10 and 100 provide advantages of the commonly used caps. For example, one advantage is that if the liquid concentrate inadvertently drips onto an exterior of the sidewall of the cap tops 28 and 128, the liquid concentrate would not drip all the way down the sidewall onto an underlying surface, but would be directed to and received in the collecting channels 82 and 182 as described above. Another advantage is that the cap tops 28 and 128 provide at least a double seal relative to the container bodies 12 and 112 when they are mated with the cap bases 26 and 126, restricting the liquid concentrate from flowing into and/or past the threaded interface between the cap tops 28 and 128 and the cap bases 26 and 126, and/or out of the containers 10 and 100 when the containers 10 and 100 are inadvertently turned over. An additional advantage is that the flanges 78 and 178 of the cap tops 28 and 128 that form the collection channels 82 and 182 have external threads 84 and 184 spaced away from the collecting channels 82 and 182 such that the threads 84 and 184 of the cap tops 28 and 128 are not exposed to the fluid concentrate when it is being dispensed from the container bodies 12 and 112 into the cap tops 28 and 128. This can restrict and/or prevent the threads 84 and 184 of the cap tops 28 and 128 and the cap bases 26 and 126 from becoming soiled due to exposure to the liquid concentrate.

To open the container shown in FIG. 1, the consumer may grasp the shrink wrap 86 at the pull tab 83 and pull the shrink wrap 86 in a downward direction to propagate tear lines in the shrink wrap 86 along the score lines 87 and 88, and around the container body 12 along the ring-like score line 89 to open the shrink wrap 86 and separate a portion of the shrink wrap 86 above the score line 89, which at this time may be discarded. After opening the shrink wrap 86, the consumer may rotate the cap top 28 to disengage the outer thread 84 of the cap top 28 from the inner thread 40 of the cap base 26 until the cap top 28 is removed from the cap base 26.

The removal of the cap top 28 disengages both the first seal S1 between the inner threads 40 of the cap base 26 and the outer threads 84 of the cap top 28, the second seal S2 between the bottom edge 68 of the sidewall 74 of the cap top 28 and the upwardly facing surface of the funnel 42 of the cap base 26, and if present, the optional third seal S3 between the landing 79 of the shoulder 78 of the cap top 28 and the top edge 34 of the wall 32 of the cap base 26. Even with first, second and third seals S1, S2, and S3 removed, the container body 12 of the container 10 remains sealed because the film 30 fully covers the container opening 20. Prior to dispensing the liquid concentrate from the container 10, the tamper-evident member 54 may be utilized to remove a portion of the sealing film 30 to provide a dispensing opening 62 in the film 30 through which the liquid concentrate may flow from the interior 20 of the container body 12 onto the spout 46. Specifically, in order to remove the tamper-evident member 54, the consumer would first insert a finger through the gap between the free edges 50 and 52 of the spout 46 and into the opening 60 of the pull ring 58. The consumer can then urge the pull ring 58 in a direction away from the dispensing surface 48 of the spout 46 and toward the gap between the free ends 50 and 52 of the spout 46.

Since the pull ring 58 is attached to the base 56 of the tamper-evident member 54 as shown in FIGS. 6-8, the urging force being applied by the consumer to the pull ring 58 pulls the base 56 together with the pull ring 58 and separates the base 56 from the perimeter of the opening 44 in the funnel 42. In the approach, shown in FIG. 8, the separation of the base 56 from the perimeter of the opening 44 includes the breaking of the connecting ribs 57. As the consumer urges the pull ring 58 through the gap between the opposed free ends 50 and 52 of the spout 46, the pull ring 58 and the base 56 of the tamper-evident member 44 become fully separated from the funnel 42 of the cap base 26. Since the base 56 of the tamper-evident member 54 is attached (e.g., by welding) at the seal area 49 to a portion of the film 30 within the perimeter of the opening 44 and at the seal area 51 to a portion of the film 30 outside of the perimeter of the opening 44, as discussed in more detail above and depicted in FIG. 7, the separation of the base 56 away from the funnel 42 also removes a portion of the film 30 surrounded by the seal area 51, with the tear preferably initiating in or close to the gap G, to form a dispensing opening 62 in the film 30.

After the tamper-evident member 54 is removed and the dispensing opening 62 is formed, the consumer may pour the liquid concentrate from the interior 20 of the container body 12 into a desired receptacle. Preferably, the liquid concentrate is to be dispensed into the interior 72 of the cap top 28. For this purpose, the cap top 28 can be inverted to expose the opening 70 and the container body 12 can be tilted by the consumer to a degree necessary to cause the liquid concentrate to be dispensed from the container body 12 into the cap top 28.

When the consumer pours the liquid concentrate into the cap top 28, the liquid concentrate first flows from the interior 22 of the container body 12 through the container opening 20, then through the dispensing opening 62 formed in the film 30, then through the opening 44 in the funnel 42, and onto the dispensing surface 48 of the spout 46. As described above, the dispensing surface 48 of the spout 46 is concave, forming a chute-like structure that direct the liquid concentrate and restricts the liquid concentrate from dripping and/or spilling over the edges 50 and 52 of the spout 46. The consumer may pour the liquid concentrate from the container body 12 into the interior 72 of the cap top 28 until the level of the liquid concentrate reaches one of the level indicators 76 or 78. The presence of the level indicators 76 and 78 facilitates the consumer to pour an appropriate amount of the liquid concentrate for an intended RTD. The measured amount of the liquid concentrate poured into the cap top 28 may be further mixed with a liquid such as water, soda, juice, or the like to form a potable RTD. It will be appreciated that the liquid concentrate may itself be potable such that further mixing of the liquid concentrate with another solution is unnecessary.

As described above, the liquid concentrate that drips and/or spills onto the cap top 28 at the top edge 68 of the sidewall 74 will be directed down the sidewall 74 of the cap top 28 into the collecting channel 82. As such, the collecting channel 82 effectively restricts the liquid concentrate from undesirably dripping down the sidewall 74 and onto underlying surfaces.

While preferred embodiments have been described in detail, variations and modifications can be effected within the configurations described herein.

The invention claimed is:

1. A container for dispensing a liquid concentrate, the container comprising:

a container body having a top end, a bottom end, and a sidewall connecting the top and bottom ends and defining a hollow interior for storing the liquid concentrate, the top end of the container body including a top edge surrounding a container opening;

a cap base sealed relative to the top edge of the container body, the cap base including a wall having a top edge and a bottom edge, the wall having an inner thread, the cap base further including a funnel surrounding an opening for directing the liquid concentrate back through the opening and into the interior of the body, the cap base further including a spout extending upwardly from the funnel adjacent the opening;

a cap top configured to be removably attached to the cap base to cover the spout and the opening of the cap base, the cap top having a closed top end, a bottom edge surrounding an opening, a sidewall therebetween, and an outwardly extending shoulder disposed about the sidewall of the cap top, the shoulder including a flange having an outer thread and depending downwardly therefrom to define a channel open toward the bottom edge of the cap top and at least partially located between the flange and an opposing portion of the sidewall of the cap top, the channel being adapted to collect liquid concentrate drip along an exterior portion of the sidewall of the cap top between the bottom edge of the cap top and the channel, the cap top having a closed position threadingly engaged with the cap base where an outer seal is formed between at least one of the shoulder and the flange of the cap top and the wall of the cap base and an inner seal is formed between the bottom edge of the sidewall of the cap top and the funnel of the cap base.

2. The container of claim 1, further comprising gripping means for dispensing the liquid concentrate in a preferred orientation of the spout.

3. The container of claim 1, further comprising a shrink wrap sleeve covering at least a portion of each of the cap top, cap base, and container body and including means for opening the sleeve to permit removal of the cap top.

4. The container of claim 1, wherein the flange extends downwardly from the shoulder a shorter distance than an adjacent portion of the sidewall of the cap top.

5. The container of claim 1, further comprising a film attached to the top edge of the container body to seal the container opening.

6. The container of claim 5, wherein at least a portion of the film is separable from a remainder of the film to form a dispensing opening in the film aligned with the opening of the cap base.

7. The container of claim 6, further comprising a tamper-evident member removably attached to at least a portion of a perimeter of the opening of the cap base, the tamper-evident member being attached to a portion of the film, the tamper-evident member being configured to separate from the portion of the perimeter of the opening of the cap base to remove at least a portion of the film to form the dispensing opening in the film.

8. The container of claim 5, wherein the cap base is sealed relative to the top edge of the container via the film.

9. The container of claim 1, wherein at least a portion of the spout extends above the top edge of the wall of the cap base.

10. The container of claim 1, wherein the funnel extends radially in a downward direction toward the bottom edge of the wall of the cap base, the funnel being oriented at an angle of at least 15 degrees relative to a horizontal plane.

11. The container of claim 1, wherein the container opening and the opening of the cap base each have a central axis passing therethrough, the central axis of the opening surrounded by the funnel being offset from the central axis of the container opening.

12. The container of claim 1, wherein the opening of the cap base has a tear-drop shape oriented such that the liquid concentrate is directed onto a dispensing surface of the spout through an apex of the tear-drop.

13. The container of claim 1, wherein the sidewall of the cap top includes at least one visual indicator for use in measuring liquid concentrate in the cap top, and wherein the side wall of the cap top is at least in part transparent such that the at least one visual indicator is visible from both sides of the sidewall of the cap top.

14. The container of claim 1, wherein no portion of the cap base passes through the container opening into the interior of the container.

15. The container of claim 1, further in combination with a liquid concentrate.

16. The container of claim 1, wherein the wall of the cap base is curved from the top edge of the cap base to the bottom edge of the cap base and extends outwardly in a direction from top to bottom relative to a central longitudinal axis of the container.

17. The container of claim 1, wherein the outer seal is formed between a landing of the shoulder of the cap top and a top edge of the wall of the cap base.

18. The container of claim 1, wherein the outer seal is formed between the outer thread of the flange of the cap top and the inner thread of the wall of the cap base.

19. A method of dispensing the liquid concentrate from the container of claim 1, the method comprising:

removing the cap top from the cap base to unseal the first seal and the second seal; and pouring the liquid concentrate from the interior of the container body through the opening of the cap base and into the cap top interior to a level indicator.

20. The method of claim 19, further comprising pouring the liquid concentrate from the cap top interior and collecting into the channel liquid concentrate dripping on the sidewall of the cap top above the channel following the pouring of the liquid concentrate from the cap top interior.

21. The method of claim 19, further comprising removing a portion of a film sealing the container body from within the opening of the cap base to form a dispensing opening in the film.

22. The method of claim 21, wherein the removing a portion of the film includes separating a tamper-evident member, the tamper-evident member being at least in part attached to a portion of the funnel and to a portion of the film and surrounded by the spout, in a direction away from the dispensing surface of the spout to form the dispensing opening in the film.

* * * * *